US007628419B2

(12) United States Patent
Gogarty

(10) Patent No.: US 7,628,419 B2
(45) Date of Patent: Dec. 8, 2009

(54) SNOWBOARD WITH V-SHAPED PROFILE

(76) Inventor: Sean Patrick Francis Gogarty, Viàle Caldara 13/3, Milano 20122 (IT)

( * ) Notice: Subject to any disclaimer, the term of this patent is extended or adjusted under 35 U.S.C. 154(b) by 0 days.

(21) Appl. No.: 11/424,534

(22) Filed: Jun. 15, 2006

(65) Prior Publication Data

US 2007/0001427 A1 Jan. 4, 2007

Related U.S. Application Data

(60) Provisional application No. 60/691,010, filed on Jun. 15, 2005.

(51) Int. Cl.
*A63C 5/04* (2006.01)

(52) U.S. Cl. ..... 280/609; 280/601; 280/600

(58) Field of Classification Search ..... 280/601, 280/603, 608, 607, 609, 14.22, 14.21, 14.24, 280/845, 810, 818, 600
See application file for complete search history.

(56) References Cited

U.S. PATENT DOCUMENTS 2,469,798 A * 5/1949 Trachslin ..... 280/600
3,394,944 A * 7/1968 Lowes, Jr. ..... 280/845
4,705,291 A * 11/1987 Gauer ..... 280/609
5,603,522 A * 2/1997 Nelson ..... 280/609
5,649,722 A * 7/1997 Champlin ..... 280/818
5,984,324 A * 11/1999 Wariakois ..... 280/14.24
6,257,620 B1 * 7/2001 Kenney ..... 280/810
6,523,851 B1 * 2/2003 Maravetz ..... 280/603
2003/0151215 A1 * 8/2003 Stief et al. ..... 280/14.21
2004/0032113 A1 * 2/2004 Rancon et al. ..... 280/609

* cited by examiner

*Primary Examiner*—Hau V Phan
(74) *Attorney, Agent, or Firm*—Perkins Coie LLP

(57) ABSTRACT

In one embodiment, a snowboard is provided. The snowboard includes a first snowboard portion having an outer riding edge. The snowboard also includes a second snowboard portion having an outer riding edge. The snowboard further includes a central edge piece attached to the first snowboard portion and the second snowboard portion. The first snowboard portion, second snowboard portion and the central edge piece form a profile with a V-shape.

In another embodiment, a snowboard is provided. The snowboard includes a board having a curved front end and a curved back end. The snowboard also includes a central edge piece attached to the board. The board and the central edge piece form a profile with a V-shape.

20 Claims, 3 Drawing Sheets

SNOWBOARD WITH V-SHAPED PROFILE

CROSS-REFERENCE TO RELATED APPLICATION

This application claims priority to prior U.S. Provisional Patent Application No. 60/691,010, entitled "SNOWBOARD WITH V-SHAPED PROFILE" and filed on Jun. 15, 2005.

BACKGROUND

Classically, skis were used to travel over snow in the northern parts of Europe. Two separate slender boards were strapped to a skier's feet, and they could travel over snow. Later, skis were used for recreational purposes to travel down snow-covered mountains. Skiing became a popular sport among those who lived near mountains and those who could afford to travel to ski resorts. Skis and bindings developed into specialized technologies that have been the subject of many patents.

Separately, surfing and surfboards developed on the California coast. Sneaking through farm fields to get to the coast, would-be surfers near Santa Cruz, Calif. would carry their surfboards to the beaches. Once there, surfers balanced on surf boards as they rode waves coming in from the Pacific Ocean. Surfboards developed into long and short boards and a variety of related devices such as windsurfers (sailboards) and boogie boards, and were also the subject of many patents.

These two inventions came together in Incline Village on Lake Tahoe. Burton, a student at the time, decided to surf the mountain. He created a contraption that used the single wide plank of a surfboard, and bindings similar to those used on skis, allowing one to use boots when riding. Thus, the snowboard was born. From these initial beginnings, snowboards went from second-class technology on mountains, often prohibited at many resorts, to an extremely popular alternative to skis on essentially all mountains.

Snowboards and indeed skis, work by compressing the snow or ice under the board causing a small amount of the snow or ice to melt. The resulting water from the melt is trapped between the snow or ice under the board and the underside of the board. The water between the snow or ice and the board provides a very low drag contact interface between board and slope resulting in a fast descent of board and rider. Although this arrangement is a low drag or low friction system, friction or drag remains. It is this remaining drag or friction that determines the speed of a given board rider and slope gradient combination. The amount of drag is directly related to the contact area between board and snow or ice.

Slow progress down a mountain may be desirable to novices. However, fast boards are generally desired by experienced users. Thus, it may be desirable to provide a snowboard with a reduced surface area in contact with snow.

Conventional snowboards are controlled directionally by the rider by shifting weight from one side of the board to the other. This is done progressively depending on the sharpness of the turn desired. The sharpest of turns are provided by shifting so much weight to one side that the whole board is tilted about its longitudinal axis until the board is riding on one of its outer edges. These outer edges are hardened with a sharp steel strip embedded in the edge and curved. Seen in plan view from above the left and right edges of the boards are slightly concave. When riding on these concave edges the board turns in the corresponding arc that the concave edge dictates. This system works well when the rider wishes to turn one way or the other.

The system has several drawbacks. If the rider wishes to progress on a straight course particularly on compact snow or ice, the rider must rapidly switch from one side to the other. Without switching, the board tends to wander, due to changing snow conditions. When a board wanders, it can "catch an edge" on the snow, by having an edge of the board bite into snow due to an imperfection encountered in the snow. Thus, it may be useful to provide a board which allows for improved stability.

It may be useful to provide a snowboard in which the rider may rapidly switch from an edge to the other without the risk of catching an edge. Such a snowboard may allow for improved stability. Moreover, the snowboard may involve the nose and the tail of the board both curved upwards and flat or wherein only one of the nose and the front, preferably the nose, is curved upwards. Also, such a snowboard may have a reduced area contact with the snow. Such a snowboard may be highly reliable, relatively easy to manufacture and at a competitive cost.

SUMMARY

The present invention is described and illustrated in conjunction with systems, apparatuses and methods of varying scope. In addition to the aspects of the present invention described in this summary, further aspects of the invention will become apparent by reference to the drawings and by reading the detailed description that follows.

In one embodiment, a snowboard is provided. The snowboard includes a first snowboard portion having an outer riding edge. The snowboard also includes a second snowboard portion having an outer riding edge. The snowboard further includes a central edge piece attached to the first snowboard portion and the second snowboard portion. The first snowboard portion, second snowboard portion and the central edge piece form a profile with a V-shape.

In another embodiment, a snowboard is provided. The snowboard includes a board having a curved front end and a curved back end. The snowboard also includes a central edge piece attached to the board. The board and the central edge piece form a profile with a V-shape.

Embodiments of the invention presented are examples and illustrative in nature, rather than restrictive.

BRIEF DESCRIPTION OF THE DRAWINGS

Embodiments of the invention are illustrated in the figures. However, the embodiments and figures are illustrative rather than limiting, they provide examples of the invention.

DETAILED DESCRIPTION

Figure 1A:
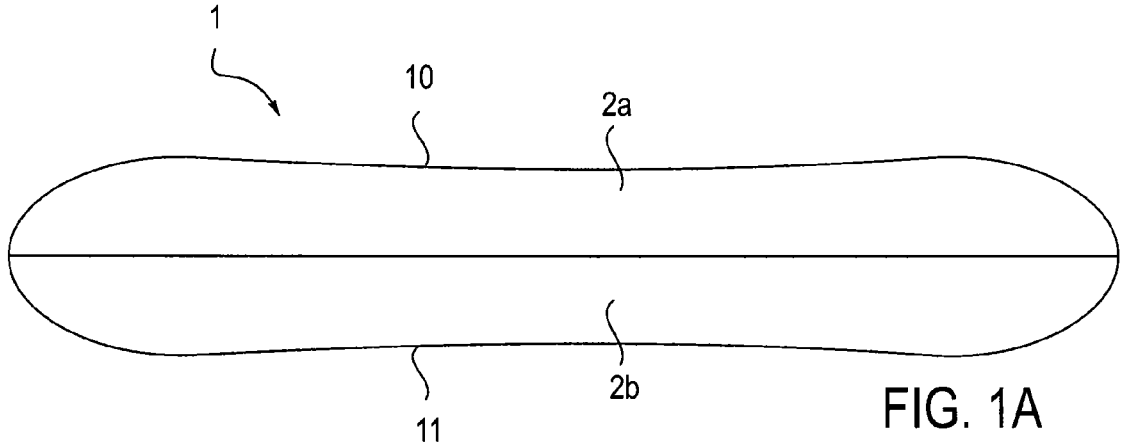
FIG. 1A illustrates an embodiment of a snowboard from a top view.
Figure 1B:
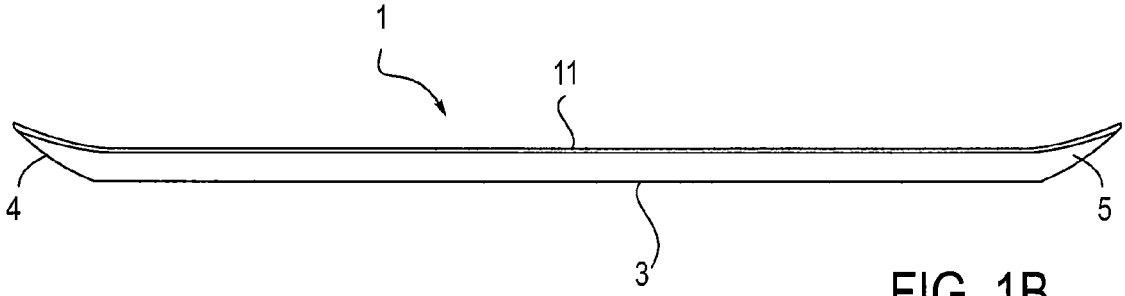
FIG. 1B illustrates the snowboard of FIG. 1A from a side view.

In various embodiments, a snowboard with a V-shaped profile is provided. In the following description, for purposes of explanation, numerous specific details are set forth in order to provide a thorough understanding of the invention. It will be apparent, however, to one skilled in the art that the invention can be practiced without these specific details. In other instances, structures and devices are shown in block diagram form in order to avoid obscuring the invention.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment, nor are separate or alternative embodiments mutually exclusive of other embodiments.

In various embodiments, a new form of snowboard that differs radically from existing conventional designs is provided. The principle difference illustrated in these embodiments is the addition of a third "riding edge" running longitudinally along the middle of the bottom surface of the board. The third edge forms the apex of the "v" profile of the board which is the other key difference from conventional designs. Current snowboard designs are flat in section whereas these embodiments include a shallow "V" section with a sharp (steel) apex.

Snowboards and skis, work by compressing the snow or ice under the board causing a small amount of the snow or ice to melt. The resulting water from the melt is trapped between the snow or ice under the board and the underside of the board. The water between the snow or ice and the board provides a very low drag contact interface between board and slope resulting in a fast descent of board and rider. Although this arrangement is a low drag or low friction system, friction or drag remains. It is this remaining drag or friction that determines the speed of a given board rider and slope gradient combination. The amount of drag is directly related to the contact area between board and snow or ice.

The shallow "V" profile or section of the board provided here dramatically reduces the contact area between board and snow or ice as the rider is mainly riding on the apex of the "V". Additionally when the rider is turning the board to the right or left he or she will ride on one half of the shallow "V" or the other. As only around half of the "normal" contact area vs. a conventional board will be interfacing with the snow or ice, drag will be reduced by up to 50% and speed increased by a corresponding margin.

Conventional flat boards are controlled directionally by the rider by shifting weight from one side of the board to the other. This is done progressively depending on the sharpness of the turn desired. The sharpest of turns are provided by shifting so much weight to one side that the whole board is tilted about its longditudinal axis until the board is riding on one of its outer edges. These outer edges are hardened with a sharp steel strip embedded and curved. Seen in plan from above the left and right edges of the boards are slightly concave. When riding on these concave edges the board turns in the corresponding arc that the concave edge dictates. This system works well when the rider wishes to turn one way or the other. The system has several drawbacks if the rider wishes to progress on a straight course particularly on compact snow or ice.

If the rider wishes to progress on a straight course the rider must constantly and rapidly correct the tendency of the board to wander left or right. This wandering is due to the changing surface of the snow which is typically uneven and already "tracked" by other boarders or skiers. This is particularly difficult on compacted snow or ice as the surface does not compress much further under the rider and so does not provide directional stability that soft snow provides. While in soft snow, the board and rider form a shallow trench in the snow with sides that reduce the tendency of the board to wander, but in hard snow or ice, such trenches are not easily formed.

When a board wanders left or right from a desired course it quickly becomes highly unstable, often resulting in the rider "catching an edge" and consequently falling, possibly sustaining injury. The dynamics of the common "catching an edge" fall are as follows—The rider is moving at speed down a slope hoping to go straight ahead. Due to poor balance and/or normal imperfections in the surface of the snow, the board wanders left or right of the current direction. If this wandering is not instantly corrected the board wanders further off course rapidly, this causes the centre of gravity of the rider to create a turning monent on the board tilting the board, the tilting makes the edge of the board bite into the snow or ice at up to 90 degrees variance to the direction of travel and momentum of the rider. As a consequence the rider falls at speed either backwards or forwards onto the slope—often sustaining an injury in the process.

Embodiments of a v-shaped snowboard significantly reduce the chances of "catching an edge" and can therefore be ridden on a straight course much more effectively. This improved directional stability is provided by the centre riding edge. The centre edge running lengthwise along the board greatly helps reduce the tendency of the board to wander as it encounters imperfections in the snow and ice surface. Moreover as the front of the snowboard curves upwards (as with conventional boards) the leading edge of the middle riding edge, ie. that part of the middle riding edge that is most forward of the rider in contact with the snow will steer the overall direction of the board. This is because the edge rises up from the snow surface with the curvature of the board and presents an angle to the surface, and as the board tilts from one side to the other displaces snow or ice to the left or right moving the nose of the board in the opposite direction to the displacement. This system of forces can be compared to the prow of a planing speedboat tilting and displacing water one way or the other and turning the boat as a result.

In further detail and with reference to the figures, the reference numeral 1, provides a first snowboard portion 2*a* having an outer riding edge 10, a second snowboard portion 2*b* having an outer riding edge 11 and a central edge piece 3 attached to the first snowboard portion 2*a* and the second snowboard portion 2*b*. The first snowboard portion 2*a* and the second snowboard portion 2*b* connected to the opposite sides of the central edge piece 3. The central edge piece 3 has a V-shaped profile at the face that is designed to make contact with the snow and the first and second snowboard portions are configured, when connected to the central edge portion 3, as extensions of the V-shaped central edge portion 3.

In this way, when the three elements are assembled together, the central edge portion 3 defines the third riding edge and the first and second snowboard portions 2*a*, 2*b* are located at the sides of the central edge 3 and result to be angled with respect to the contact plane whereon the third riding edge makes contact.

Figure 2:
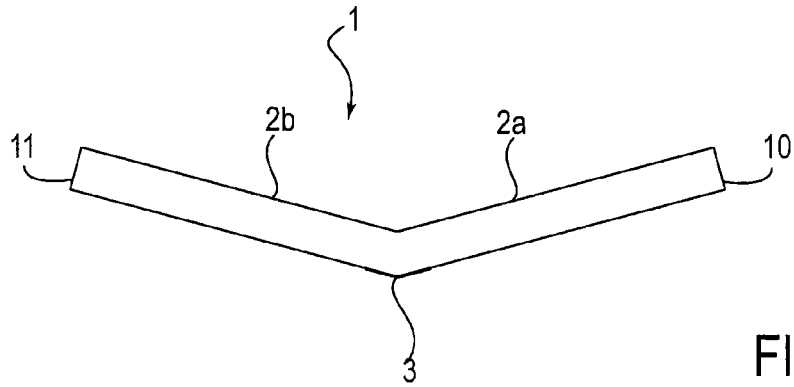
FIG. 2 illustrates an embodiment of a snow board with a V-shaped profile and center edge in a cross-section view.
Figure 3:
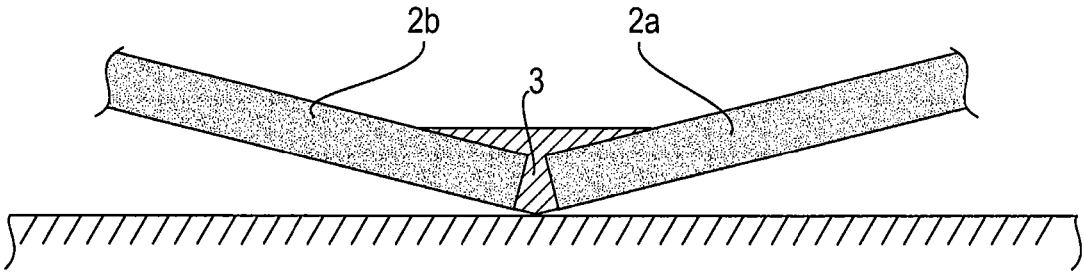
FIG. 3 illustrates the snowboard of FIG. 2 on snow in a closeup view.

Construction:

Construction of a v-shaped snowboard may be implemented with a variety of embodiments. There are two principle methods of construction with material and design variants to each method. These principal methods may be understood as "Twin Plate" and "monocoque" methods. Other methods may also be useful with various embodiments. FIG. 2 illustrates an embodiment of a snow board with a V-shaped profile and center edge in a cross-section view. FIG. 3 illustrates the snowboard of FIG. 2 on snow in a closeup view. The embodiment illustrated in the figures may be constructed using various methods and materials, such as those described below.

1. Twin Plate

This design and construction approach is based on existing snowboard construction methods with some additions. The design is the one already described formed with two halves of a regular snowboard joined by a dividing strip (the Divider) which performs a number of functions.

The Twin plates (e.g. the first and second snowboard portions 2*a*, 2*b*): The plates that are attached to the Divider are laminated and formed units that are curved up at the front and back ends as with conventional snowboards. They have curved concave outside edges made from steel or similarly hard but flexible metal or alternative material (such as ceramic). The metal edges are made by embedding steel strips in the board during the lamination process which forms the board. Snowboards and the plates here described are constructed by lamination of a variety of materials including but not limited to wood, fiberglass, carbon fibre, Kevlar, aluminum and, steel honeycomb. The final laminate strip on the riding surface is made of a plastic (often poly carbonate) which is impervious to water, low friction and able to accept wax as a final finish.

The Twin Plates are attached to the central Divider which also forms the central riding edge described earlier. The Divider has a shallow "Y" section. The bottom of the "Y" provides the riding edge and the arms of the "Y" provide the means to attach the inner edges of the plates. The upper edges of the Divider extend over the top surface of the Twin Plates and are attached to them. They can be attached by a number of methods.

a) The top surface of the Twin Plates stuck (chemically bonded) to the underside of the Divider strip.

b) The upper strips of the Divider (the arms of the "Y" section) bonded between the plate laminates during the lamination process.

c) The Divider riveted to the Twin Plates, flat head rivets holding the plates to the Divider, ground smooth and flush with the riding surface on the underside.

The method of attachment is only important to the function of the board in as much as the plates remain attached to the Divider and that the smoothness and water resistance of the bottom riding surface is ensured. Other methods of attachment may also be used.

The Divider: As explained earlier the Divider has a "Y" section, to provide means of holding the Twin Plates together whilst also providing the bottom riding edge. Stainless steel is one potential material for the Divider but it can also be made from wood or carbon fibre, fibre glass or aluminum or another form of rigid yet flexible material. Moreover, various combinations of materials may be used, such as materials listed above with a steel riding edge inserted in it. The main part of the "Y" section can be made from the materials above but the foot of the "Y", the riding edge, can be a steel strip bonded on, or a steel strip of an inverted "T" profile that is jammed into a slit in the Divider with or without bonding agent depending on the force of the insertion and or the material that the Divider is made from.

The choice of the material for the Divider will typically be governed by the need for weight saving, flexibility of the board and durability. Thus, a larger size board designed for a heavier rider may involve strength above weight saving and a Divider completely made from stainless steel might be selected. A lighter rider keen on jumps etc. may value weight saving and flexibility more highly and so a carbon fibre Divider with a stainless steel riding edge insert might be selected. A board with a "natural woody" feel to it may use a wooden Divider with a stainless steel insert or bonded strip. The Divider would typically curve up at the front and back edge of the board in line with the Twin Plates. If the Divider is made from steel it may either be pressed and cut from sheet steel or extruded from molten steel. In both cases the piece is simply bent to shape to meet the desired profile. If made of carbon fibre or fibre glass the shape may be moulded in during the manufacturing process, if wood, it can be cut or steamed to shape from solid wood, or laminated to shape using strips of wood and bonding agent.

Binding Plates: The Binding Plates allow the commonly used snowboard boot bindings to be attached to the board. These plates also act as ties between the upper surfaces of the Twin Plates providing strength against crushing at the critical point of load from the rider. The Binding Plates are blocks or strips of material whose edges are bonded or otherwise attached to the upper surface of the Twin Plates and are threaded or have embedded in them threaded cylinders that accept the commonly used screws that attach bindings to boards. The Binding Plates can be made from a variety of materials which then determines the method of attachment to the Twin Plates.

a) Metal (stainless steel, for example): In this case the Binding Plates will have left and right edges that bend up to be parallel with the surface of the Twin Plates enabling them to be bonded or riveted to the Twin Plates whilst still providing a flat surface for the boot binding to attach to. The space between the underside of the binding plate and the top surface of the Divider can be filled with a spacer to provide additional strength against crushing due to rider load eg. If the design is specialised for landing from high jumps etc.

b) Wood: If the Binding Plates are made of wood they would have a top flat surface but a "v" shaped bottom surface to follow the top surface of the Twin Plates. These wooden Binding Plates are closer to blocks with a shallow inverted triangle shape. The bottom of the inverted triangle resting on the top of the Divider. Embedded in the wooden Binding Plates are threaded cylinders that also accept the commonly used screws for attaching bindings to boards. The wooden Binding Plates can be attached to the Twin Plates in a variety of ways. If made from hardwood or laminated wood they can be bonded to the Twin Plates upper surface and the upper surface of the Divider. They can also be "laminated in" as part of the construction process of the Twin Plates along with the Divider. For example, the final top layers of the Twin Plates which may be fibre glass or carbon fibre or Kevlar would be draped over the Binding Plates and then the setting resin applied to "harden off" thereby securing to and integrating the Binding Plates to the Twin Plates.

c) Plastic, fiberglass, carbon fibre etc.: In this case both the approach in a) and b) can be adopted, again metal threaded steel cylinders are embedded in the Binding Plates to accept screws.

As may be expected, various materials may be used with a variety of constructions techniques. The examples above are illustrative rather than restrictive.

2. Monocoque

This method of construction generally involves six elements, the "body", the "riding spine", the "riding edges", the "shell", the "riding surface" and the "binding plates". The construction is closer to that of a typical surfboard in that the strength of the board comes from a lightweight core with strength in compression, enclosed by a shell material that has tensile strength, creating a whole that has longitudinal, lateral and torsional rigidity whilst remaining light.

a) Body: The body is made in two halves from a light but not easily compressed material such as, balsa wood, expanded polystyrene, aluminium honeycomb, other plastic foams or two airtight plastic chambers made from a material such as polypropolene, PET (polyethylene terephthalate) or poly carbonate. The body has a shallow inverted triangle section and is divided into two halves vertically down the center line. This provides two right-angled triangles with long upward facing sides that support the top surface of the board and long downward facing sides that support the riding surface of the board that is in contact with the snow. The short vertical sides of each half attach to the riding spine described later. In plan the two halves of the body form a shape not dissimilar to a conventional snowboard in that it is approximately as long and wide as a conventional snowboard and its outer side edges are concave, narrowing to the middle of the board. In side view the body is mostly flat but curves up away from the horizontal both at the right and left (front and back) of the board as with a conventional board.

b) Riding Spine: The riding spine has a number of functions. It runs the entire length of the board and provides the middle riding edge as described above. The riding spine also supports the binding plates described below. It is essentially a narrow metal, or non-metal component with metal attached, strip arranged vertically with a 1-3 mm metal riding edge at the bottom and metal or other tags rising from that providing a means of attaching the body described above. The tags are cut from the strip leaving space between each tag to allow the riding spine to flex along its length in use without deforming permanently. Viewed from the side the riding spine would resemble a fish skeleton cut in half down the length of the fish, the solid part providing the riding edge and the tags rising from it like fish bones. In two sections the riding edge may be solid from the edge itself to the top part, with these solid sections supporting the binding plates described below.

c) Riding edges: The riding edges are made of stainless steel and are very similar to the edges of conventional snowboards. They run the length of the outer edges both left and right of the board when seen in plan. The edge in contact with the snow is between 1 and 3 mm wide. Like the riding spine described above they are long strips of metal with a solid portion that is in contact with the snow or ice which has metal tags extending from it which enable the edge to be attached to the body halves. The tags are bonded between the underside of the body halves and the riding surface which is described below. This holds them in place and allows the edges to flex without deforming permanently.

d) Shell: The shell material encloses each half of the body. It is made of fiberglass, carbon fibre, Kevlar or simlar woven sheet and draped around the body halves impregnated with resin and hardened off. This provides two lightweight but strong body halves. When assembled with the riding spine and the binding plates the underside of the shell covered body provides the face on which the riding surface is attached (bonded).

e) Riding surface: The riding surface is made up of two sheets of plastic cut to size and bonded to the bottom surface of the shell, meeting the sides of the riding Spine and side riding edges flush, much in the way it does on a conventional snowboard. The riding surface is made of polycarbonate or another plastic that provides a low friction water impervious surface to interface with the snow and ice.

f) Binding Plates: The binding plates are flat rectangles of metal or other material. The metal plates are formed with threaded holes to accept conventional screws and bindings for snowboard boots. Non metal binding plates must have metal threaded cylinders embedded within them to accept bindings and screws. The Binding plates are mounted on top and at right angles to the solid sections of the Riding Spine, this allows the weight of the rider to be transferred directly to the riding spine snow contact edge. The binding plates are be bonded to the outer surface of the shell and strongly attached to the riding spine. This is required to deal with the strong forces created when the rider is using an outside riding edge at speed to turn or stop.

Figure 5A:
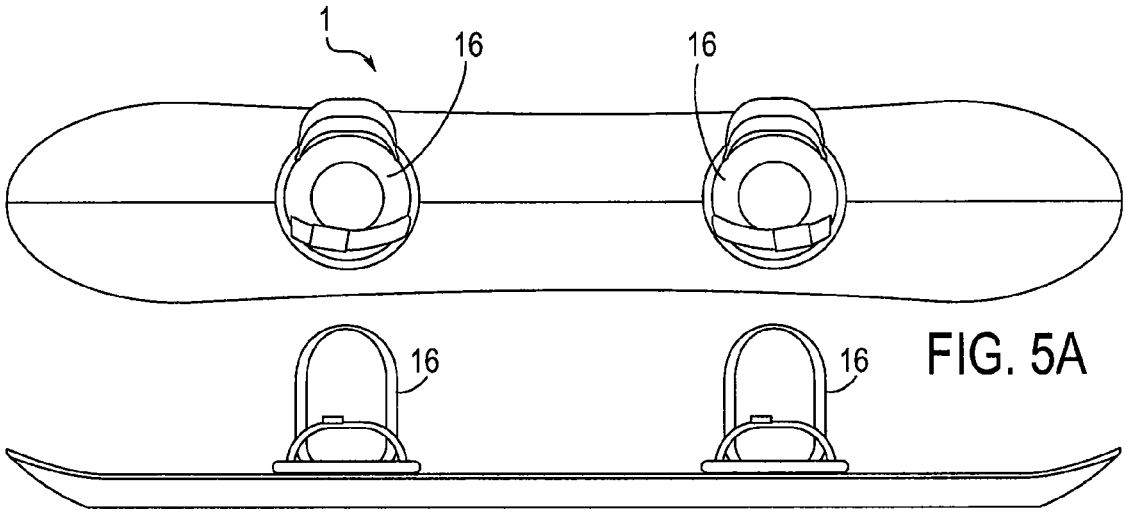
FIG. 5A illustrates an embodiment of a snowboard with bindings from a top view.
Figure 5B:
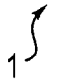
FIG. 5B illustrates the embodiment of a snowboard of FIG. 5A from a side view.
Figure 5C:
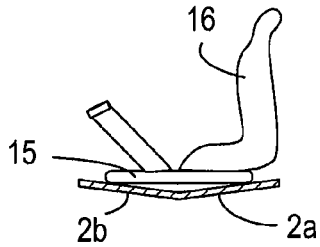
FIG. 5C illustrates the embodiment of a snowboard of FIG. 5A from a front view.
Figure 6:
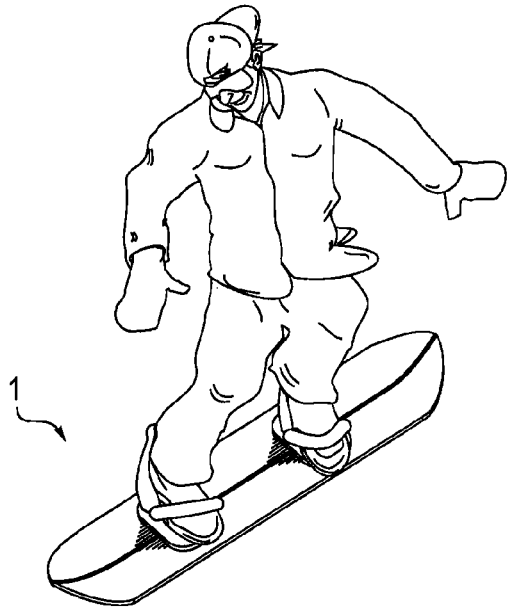
FIG. 6 illustrates the embodiment of a snowboard of FIG. 5A with a rider as seen from a perspective view.

The binding plates 15 and bindings 16 are illustrated, in one embodiment, in FIGS. 5A-C. FIG. 5A illustrates an embodiment of a snowboard 1 with bindings 16 from a top view. FIG. 5B illustrates the embodiment of the snowboard of FIG. 5A from a side view. FIG. 5C illustrates the embodiment of the snowboard of FIG. 5A from a front view. FIG. 6 illustrates the embodiment of the snowboard of FIG. 5A with a rider as seen from a perspective view.

As can be seen, the binding plates 15 bridge the V-shaped section, providing a flat platform on which the rider may stand. Optionally, the binding plates 15 may have further support extending down to the central spine 3 (the Riding Spine) for further support. In some instances, this may be viewed as required due to the forces exerted on the binding plates when the board is used.

Figure 4:
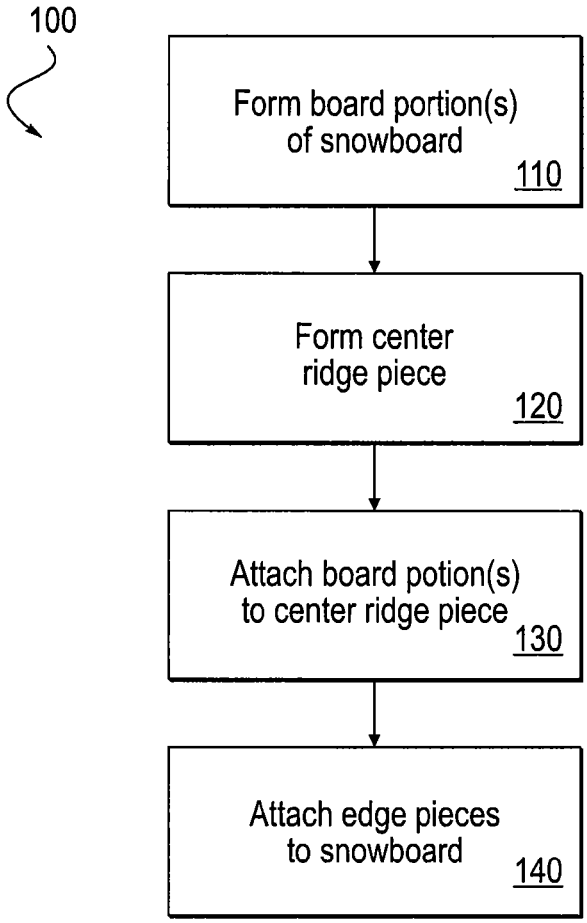
FIG. 4 illustrates an embodiment of a process of creating a snowboard with a V-shaped profile and center edge.

Such snowboards may be formed in a variety of ways. FIG. 4 illustrates an embodiment of a process of creating a snowboard with a V-shaped profile and center edge. Process 100 includes forming board portions 2*a*, 2*b*, forming a center edge piece, forming a center ridge or edge piece, attaching the board portions to the center piece, and attaching edges 10, 11 to the board portions. The board portion or portions are formed at step 110 as a monocoque or pair of snowboard portions. A center ridge piece 3 is then formed at step 120. At step 130, the center ridge piece 3 is attached to the board portion or portions 2*a*, 2*b* from step 110. If a single board portion is used, the ridge piece 3 is attached to the bottom of the board portion. If two board portions 2*a*, 2*b* are used, the center ridge piece 3 is attached to each of the two board portions, thereby joining the three pieces into a whole board. At step 140, edges are attached to the board, providing the completed snowboard with outer riding edges.

From the foregoing, it will be appreciated that specific embodiments of the invention have been described herein for purposes of illustration, but that various modifications may be made. For example, the disclosed methods and apparatuses have been described primarily in terms of multiple board and monocoque designs. In some instances, reference has been made to characteristics likely to be present in various or some embodiments, but these characteristics are also not necessarily limiting on the potential implementations of other embodiments. In the illustrations and description, structures have been provided which may be formed or assembled in other ways, and may be combined or subdivided in various embodiments.

What is claimed is:

1. A snowboard, comprising:

a first snowboard portion having a first concave outer riding edge;

a second snowboard portion having a second concave outer riding edge; and a central edge piece attached to the first snowboard portion and the second snowboard portion, wherein the central edge piece is configured to secure the first snowboard portion and the second snowboard portion to form a V-shaped structure; and wherein at least one portion of the central edge piece is located external to the V-shaped structure.

2. The snowboard of claim 1, wherein:

a first end of the snowboard is curved upward.

3. The snowboard of claim 2, wherein:

a second end of the snowboard is curved upward.

4. The snowboard of claim 1, further comprising:

a first binding attached to the first snowboard portion and to the second snowboard portion.

5. The snowboard of claim 4, further comprising:

a second binding attached to the first snowboard portion and to the second snowboard portion.

6. The snowboard of claim 1, further comprising:

first means for attaching a foot to the first snowboard portion and to the second snowboard portion.

7. The snowboard of claim 6, further comprising:

second means for attaching a foot to the first snowboard portion and to the second snowboard portion.

8. The snowboard of claim 1, wherein:

the central edge piece is riveted to the first snowboard portion and the second snowboard portion.

9. The snowboard of claim 1, wherein:

the central edge piece is a metal piece having a first side for the first snowboard portion and a second side for the second snowboard portion and the central piece is riveted to the first snowboard portion and the second snowboard portion.

10. The snowboard of claim 1, wherein:

the central edge piece is fused to the first snowboard portion and the second snowboard portion.

11. The snowboard of claim 1, wherein:

each of the first and second snowboard portions includes:

a body;

a shell surrounding the body;

a concave outer riding edge attached to the shell; and a riding surface attached to a bottom surface of the shell.

12. The snowboard of claim 11, wherein:

the shell is Kevlar.

13. The snowboard of claim 11, wherein:

the riding surface is polycarbonate.

14. The snowboard of claim 11, wherein:

the body is expanded polystyrene.

15. The snowboard of claim 11, wherein:

the central edge piece is riveted to the first snowboard portion and the second snowboard portion;

the shell is Kevlar;

the riding surface is polycarbonate; and the body is expanded polystyrene.

16. The snowboard of claim 1, wherein the first snowboard portion and the second snowboard portion are separate pieces.

17. The snowboard of claim 1, wherein the first snowboard portion and the second snowboard portion is a single snowboard.

18. A snowboard, comprising:

a first snowboard portion having a first concave outer riding edge, wherein the first outer riding edge is a first strip of hardened material that borders a first longitudinal side of the first snowboard portion;

a second snowboard portion having a second concave outer riding edge, wherein the second outer riding edge is a second strip of hardened material that borders a second longitudinal side of the second snowboard portion;

a central edge piece attached to the first snowboard portion and the second snowboard portion, wherein the central edge piece is configured to secure the first snowboard portion and the second snowboard portion to form a V-shaped structure; and wherein at least one portion of the central edge piece is located external to the V-shaped structure.

19. The snowboard of claim 18, wherein:

the central edge piece is a metal piece and is attached to the bottom of the board.

20. A snowboard, comprising:

a board having a curved front end and a curved back end, wherein the board includes:

a first snowboard portion having a first concave outer riding edge, wherein the first outer riding edge is a first strip of hardened material that borders a first longitudinal side of the first snowboard portion;

a second snowboard portion having a second concave outer riding edge, wherein the second outer riding edge is a second strip of hardened material that borders a second longitudinal side of the second snowboard portion;

a first means for attaching a first foot to the board;

a second means for attaching a second foot to the board; and a central edge piece providing a means of holding the first snowboard portion and the second snowboard portion in a V-shaped structure;

wherein a portion of the central edge piece is located external to the V-shaped structure; and wherein the central edge piece extends to the curved front end and the curved back end.

* * * * *